US006017593A

United States Patent [19]

Daly et al.

[11] Patent Number: 6,017,593

[45] Date of Patent: Jan. 25, 2000

[54] METHOD FOR PRODUCING LOW GLOSS APPEARANCE WITH UV CURABLE POWDER COATINGS

[75] Inventors: Andrew T. Daly, Sinking Spring; Richard P. Haley, Reading; Eugene P. Reinheimer, Wyomissing; Gregory R. Mill, Womelsdorf, all of Pa.

[73] Assignee: Morton International, Inc., Chicago, Ill.

[21] Appl. No.: 09/052,663

[22] Filed: Mar. 31, 1998

[51] Int. Cl.[7] ..... B05D 3/06

[52] U.S. Cl. ..... 427/559; 427/195; 427/201; 427/372.2; 427/485

[58] Field of Search ..... 427/195, 475, 427/485, 508, 512, 521, 201, 373.2, 558, 559

[56] References Cited

FOREIGN PATENT DOCUMENTS 636 669 1/1995 European Pat. Off. .
0636669A2 2/1995 European Pat. Off. .
1-256575 10/1989 Japan .
92/01757 6/1992 WIPO .

OTHER PUBLICATIONS

K.M. Biller, et al., *UV Curable Powders: A Marriage of Compliant Coatings,*Indus. Paint & Powder, Jul. 1996, 22–25.

K.M. Biller, et al.,*UV Curable Powder Coatings*, Proceedings from RadTech 96 Conference. Apr.1996, pp. 437–445.

D.S. Richart, *Powder Coatings Clinic*, Powder Coating, Apr. 1996, pp. 55–56.

*Primary Examiner*—Fred J. Parker

*Attorney, Agent, or Firm*—Steven C. Benjamin; Gerald K. White

[57] ABSTRACT

Low gloss appearance in a coating derived from UV curable powder coatings can be achieved by using UV curable powder containing crystalline resins or blends of crystalline and amorphous resins and after heat fusing the powders together, allowing the crystalline resins in the coating to cool and recrystallize to a low gloss finish before curing with UV radiation.

20 Claims, 1 Drawing Sheet

METHOD FOR PRODUCING LOW GLOSS APPEARANCE WITH UV CURABLE POWDER COATINGS

FIELD OF THE INVENTION

This invention relates to ultraviolet (UV) radiation curable powder coatings. More particularly, it relates to a method for producing cured coatings with a low gloss appearance from UV curable powder coatings.

BACKGROUND OF THE INVENTION

Thermosetting powder coatings have gained considerable popularity in recent years over liquid coatings for a number of reasons. Powder coatings are virtually free of harmful fugitive organic solvents normally present in liquid coatings, and, as a result, give off little, if any, volatiles to the environment when cured. This eliminates solvent emission problems and dangers to the health of workers employed in coating operations. Powder coatings also improve working hygiene, since they are in dry solid form and have no messy liquids associated with them to adhere to workers' clothes and coating equipment. Furthermore, they are easily swept up in the event of a spill without requiring special cleaning and spill containment supplies. Another advantage is that they are 100% recyclable. Over sprayed powders are normally recycled during the coating operation and recombined with the original powder feed. This leads to very high coating efficiencies and minimal waste generation.

Despite many advantages, powder coatings traditionally have not been used for coating heat sensitive substrates, such as wood and plastic articles, due to the rather high temperatures demanded for flow and cure. Recently, the powder coating industry has concentrated its efforts on developing low temperature curable powders. These new generation powders permit polymerization or curing at much lower temperatures, reducing the potentially damaging and deforming heat loads imposed on sensitive substrates.

One class of low temperature curable powder recently developed are the UV curable powders. UV curable powders have the ability to flow and cure and produce smoother coatings at much lower temperatures than previously possible with traditional thermosetting chemistry. This is primarily due to the curing reaction being triggered by photoinitiated radiation rather than heat. Typically, UV powders are formulated from solid unsaturated base resins with low Tg, such as unsaturated polyesters, unsaturated co-polymerizable crosslinker resins, such as vinyl ethers, photoinitiators, flow and leveling agents, performance-enhancing additives, and, if necessary, pigments and fillers. It is also common to replace all or part of the base resins or crosslinkers with crystalline materials to provide powders with lower melt viscosity and better flow out behavior.

During coating operations, UV curable powders are applied to a substrate in the usual fashion, using electrostatic spray techniques. The coated substrate is then heated for as long as it takes to drive out substrate volatiles and fuse the powders into a smooth molten coating. Immediately following fusion, the molten coating is exposed to UV light, which, in an instant, cures and hardens the film into a durable, extraordinarily smooth, attractive coating.

One drawback of UV curable powders is that it is very hard to produce a low gloss (i.e., matte) coating. The coatings formed tend to have a relatively high glossy appearance. For reasons of aesthetic preference, it would be desirable to have UV curable powder coatings which provide low gloss coatings. Gloss reduction can normally be obtained in traditional powder coatings through the introduction of matting agents, such as fillers or waxes, which rise to the surface during curing and cause matting through disruption of the surface of the coating. However, because UV curable powders cure so quickly, there is not adequate time for the fillers and waxes to flocculate to the surface, and they become trapped within the coating. There is reduction in flow in the coating but little matting takes place. Higher amounts of filler or waxes may be used, but this tends to cause the powders to block or cake during normal storage and/or produce coatings with severe orange peel, limiting the amount of gloss reduction that could be attained.

It would be desirable to provide a method for producing cured coatings with a low gloss appearance from UV curable powders.

SUMMARY OF THE INVENTION

It is, therefore, a primary object of this invention to provide a method for producing cured coatings with a low gloss appearance from UV curable powders.

In accordance with the invention, low gloss coatings having 60° Gardner Gloss levels of about 50 or below, preferably about 30 or below, are achieved with UV curable powders by including in the powder composition crystalline resins or blends of crystalline and amorphous resins, and then during the UV coating process, instead of curing the powders immediately following heat fusion, allowing the molten coating time to cool to permit the crystalline resins to recrystallize to a matte finish before curing with UV light to the desired hard, chemical resistant, smooth, low gloss coating film.

It is a related object of this invention to provide a method for producing both high and low gloss cured coatings from identical UV curable powders.

BRIEF DESCRIPTION OF THE DRAWINGS

With this description of the invention, a detailed description follows with reference made to the accompanying drawing in which.

DETAILED DESCRIPTION OF THE PREFERRED EMBODIMENTS

Figure 1:
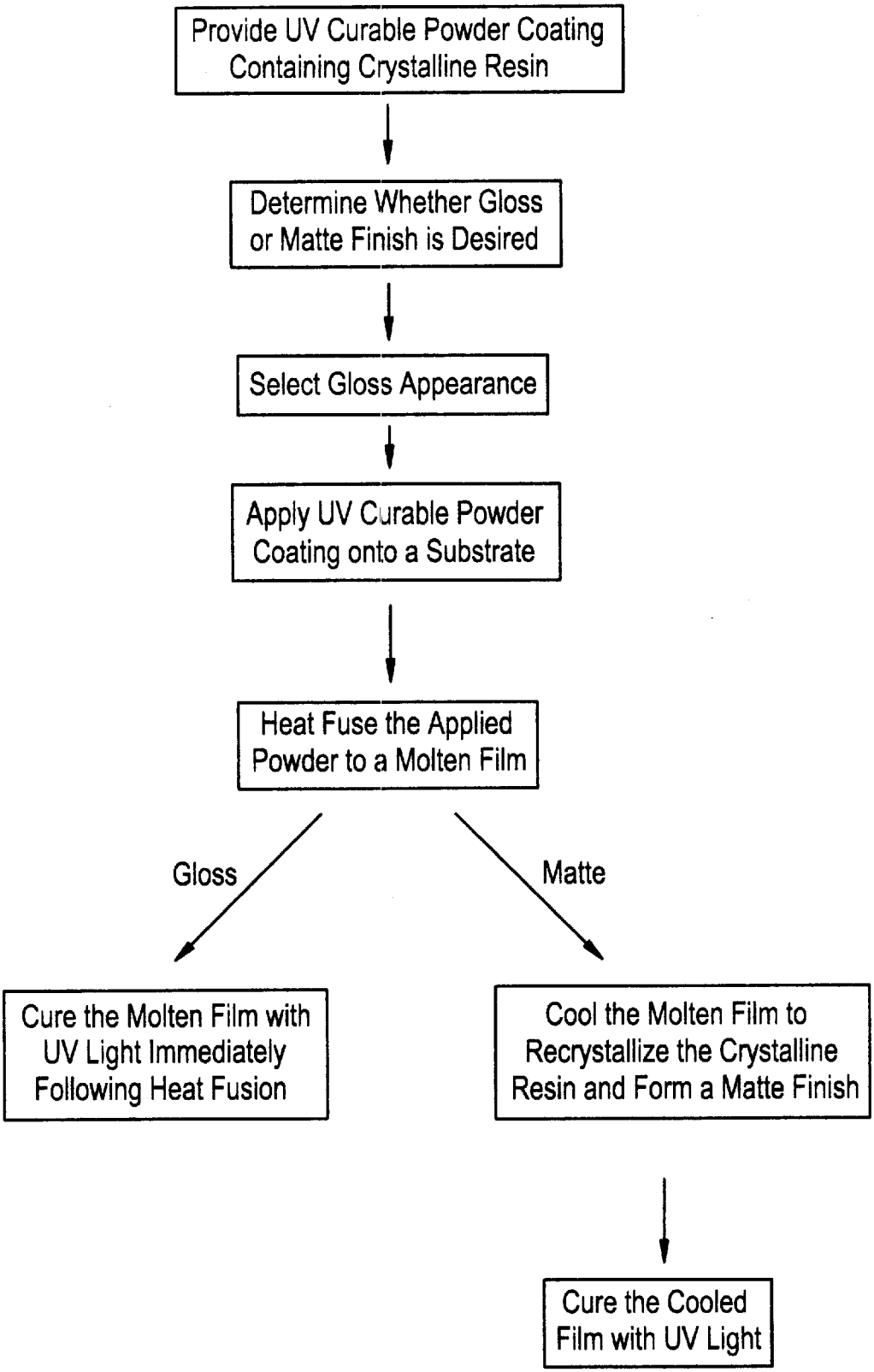
FIG. 1 is a schematic diagram showing a method for producing both high and low gloss coatings from identical UV curable powders in accordance with this invention.

Throughout this specification, all parts and percentages specified herein are by weight unless otherwise stated. Herein, the resin of the powder coating is considered to be the base resin and crosslinker resin. Levels of other components are given as parts per hundred resin (phr). Further herein, the term "low gloss" or "matte" means gloss levels of 50 or below on a 60° Gardner Gloss scale. The term "high gloss", as used herein, means gloss levels of above 50 on a 60° Gardner Gloss scale.

In UV curable powders, the base resins are typically unsaturated polyesters to impart desired weatherability to the coating. Unsaturated polyesters are formed in a conventional manner from di- or polyfunctional carboxylic acids (or their anhydrides) and di- or polyhydric alcohols. The unsaturation is typically supplied by the carboxylic acid, although it is possible to supply it through the alcohol. Often, monohydric alcohols or monofunctional carboxylic acids (or their esters) are employed for chain termination purposes.

Examples of typical ethylenically unsaturated di- or polyfunctional carboxylic acids (or their anhydrides) include maleic anhydride, fumaric acid, itaconic anhydride, citraconic anhydride, mesaconic anhydride, aconitic acid, tetrahydrophthalic anhydride, nadic anhydride, dimeric methacrylic acid, etc. Maleic anhydride, fumaric acid, or their mixtures are generally preferred because of economic considerations. Often, aromatic and saturated acids are employed in conjunction with the unsaturated acids to reduce the density of the ethylenic unsaturation and provide the desired chemical and mechanical properties. Examples of typical aromatic or saturated di- or polycarboxylic acids (or their anhydrides) include adipic acid, succinic acid, sebacic acid, malonic acid, glutaric acid, cyclohexane dicarboxylic acid, dodecane dicarboxylic acid, phthalic anhydride, isophthalic acid, terephthalic acid, tetrahydrophthalic acid, hexahydrophthalic acid, trimellitic acid, pyromellitic anhydride, etc. Examples of typical monofunctional acids for chain termination include acrylic acid, methacrylic acid, etc.

Examples of typical di- or polyhydric alcohols include ethylene glycol, diethylene glycol, triethylene glycol, propanediol, butanediol, neopentyl glycol, cyclohexanedimethanol, hexanediol, 2-n-butyl-2-ethyl-1,3-propanediol, MP Diol, dodecanediol, bisphenol A, hydrogenated bisphenol A, trimethylol propane, pentaerythritol, etc.

The unsaturated polyester resins can be formulated to have either a crystalline or amorphous microstructure. According to this invention, the resin component of the UV curable powders must contain at least one crystalline resin. The crystallinity not only provides powders with lower melt viscosity and better flow out behavior, but also is critical for producing the desired low gloss coating. It is well known in the art that certain alcohol and acid monomers impart crystallinity to the unsaturated polyesters. For example, symmetrically substituted linear monomers or cyclic monomers or their mixtures are generally used to form crystalline polyesters. Examples of typical dihydric alcohols that are known to promote crystallinity include ethylene glycol, butanediol, hexanediol, and cyclohexanedimethanol. Examples of typical dicarboxylic acids that are known to do the same include terephthalic acid, adipic acid, dodecane dicarboxylic acid, and cyclohexane dicarboxylic acid.

The unsaturated polyester resins most useful herein are solid materials at room temperature, so that they can be easily formulated into non-blocking powders. Further, the preferred resins exhibit virtually no cold flow at temperatures up to about 90° F. for desired long shelf life. They also have a glass transition temperature (Tg) and/or melting point (Tm) below the flow temperature required for preservation of heat sensitive substrates, preferably between about 160° F. and 300° F.

These unsaturated polyester resins typically have a weight average (Mw) molecular weight ranging between about 400 and 10,000, and preferably between about 1,000 and 4,500. The degree of unsaturation is typically between about 2 and 20 wt. %, and preferably between about 4 and 10 wt. %. Furthermore, whether the unsaturated polyester is hydroxyl-functional or acid-functional depends upon the —OH/—COOH molar ratio of the monomer mix. Usually, the hydroxyl-functional resins have a hydroxyl number from about 5 to 100. The acid-functional resins typically have an acid number from about 1 to 80.

The unsaturated polyester resins work best in combination with co-polymerizable crosslinker resins having ethylenic unsaturation, and preferably having two sites of unsaturation per molecule. Examples of typical crosslinker resins include oligomers or polymers having vinyl ether, vinyl ester, allyl ether, allyl ester, acrylate or methacrylate groups. Crosslinkers with vinyl ether groups are generally preferred.

Examples of typical vinyl ether resins include divinyl ether terminated urethanes. These materials are usually available as crystalline resins formed from the reaction of hydroxyl-functional vinyl ethers, such as hydroxybutyl vinyl ether, with crystalline diisocyanates, such as hexamethylene diisocyanate, hydrogenated methylenebis(cyclohexyl) diisocyanate, or biurets or uretdiones thereof. Amorphous vinyl ether terminated urethane resins can also be supplied by reacting non-crystalline isocyanates, such as isophorone diisocyanate, first with polyols, such as neopentyl glycol, and then reacting the product obtained with hydroxy vinyl ethers, such as hydroxybutyl vinyl ether.

Other suitable crosslinkers include resins having acrylate or methacrylate groups, such as dimethacrylate terminated urethanes. Again, these materials are usually crystalline resins formed by reacting hydroxyl-functional (meth) acrylates, such as hydroxyethyl methacrylate and hydroxypropyl methacrylate, with crystalline isocyanates. Amorphous resins may also be made in a similar manner as described for the amorphous vinyl ethers. Allyl ester crosslinkers are also commonly employed, such as the reaction product of allyl alcohol and crystalline or non-crystalline carboxylic acids (or their anhydrides), typically phthalic anhydride. Standard allyl ether crosslinkers include the reaction product of an allyl ether, such as allyl propoxylate, and a hydrogenated methylene diisocyanate.

The crosslinker resins most useful herein are solid materials at room temperature. Of course, if the resins are liquids, as with any of the other materials employed in the UV curable powder, they can be converted to solid by absorption onto inert silica-type filler, such as fumed silica, before use, as is well known in the art.

It will be appreciated by a person of ordinary skill in the art that the relative amounts of unsaturated base resin to unsaturated co-polymerizable crosslinker resin in the UV curable powder coatings will depend on the choice of materials employed. Usually, such materials are employed in stoichiometric equivalent amounts to allow crosslinking to proceed to substantial completion, although excess of either can be used if desired.

In accordance with this invention, to obtain the desired low gloss appearance from UV curable powders, the resin component (base resin plus crosslinker) must contain at least one crystalline resin. Accordingly, the powders may be formulated with crystalline resins alone or blends of crystalline and amorphous resins. The crystalline material is typically supplied by the crosslinker resin, although it is possible to supply it through the base resin. The amount of crystalline resin, whether base resin or crosslinker resin, present in the UV curable powders generally ranges between about 15 and 100 wt. % of the resin component, and preferably between about 20 and 50 wt. %, the balance, if any, being amorphous resin. Below 10 wt. % crystallinity, desired gloss reduction generally cannot be attained.

Standard free-radical photoinitiators are also incorporated in the UV curable powders to effect the radiation-triggered cure. Examples of typical alpha cleavage photoinitiators include benzoin, benzoin ethers, benzyl ketals, such as benzyl dimethyl ketal, acyl phosphines, such as diphenyl (2,4,6-trimethyl benzoyl) phosphine oxide, aryl ketones, such as 1-hydroxy cyclohexyl phenyl ketone, etc. Examples of typical hydrogen abstraction photoinitiators include Michler's ketone, etc. Examples of typical cationic photoinitiators include diaryliodonium salts and copper synergists, etc. Usually, the amount of photoinitiator present typically ranges between about 0.1 and 10 phr, and preferably between about 1 and 5 phr.

The UV curable powders may also include typical thermal free-radical initiators, such as organic peroxide and azo compounds, in conjunction with the photoinitiators (otherwise referred to herein as "dual cure" powders). This has been found to assist in curing near the substrate, particularly when pigmented, opaque, or thicker film coatings are desired. Examples of typical peroxide and azo initiators include diacyl peroxides, such as benzoyl peroxide, azobis (alkyl nitrile) peroxy compounds, peroxy ketals, such as 1,1-bis(t-butyl peroxy)-3,3,5-trimethylcyclohexane, peroxy esters, dialkylperoxides, hydroperoxides, ketone peroxides, etc. If employed, the amount of thermal initiator present typically ranges between about 0.1 and about 10 phr, and preferably between about 1 and 5 phr.

Standard catalysts may also be employed to increase the crosslinking rate, such as transition metal compounds based on a fatty acid or oil, or tertiary amines. Cobalt soaps, such as cobalt octoate, cobalt neodecanoate, cobalt naphthenate, and cobalt octadecanoate, are especially preferred. If employed, the amount of catalyst present is typically less than about 1.0 phr, and preferably ranges between about 0.1 and 0.5 phr.

Common additives such as pigments and fillers, flow control agents, dry flow additives, anticratering agents, surfactants, texturing agents, light stabilizers, etc., can also be used, as known to those skilled in the art. If desired, matting agents, such as polyethylene waxes, oxidized polyethylenes, polyamides, TEFLON, polyamides, can also be employed, although this invention makes them generally redundant.

The UV curable powders employed in this invention typically contain from 0 up to about 120 phr of fillers and/or pigments, depending on desired film opacity and coloration. Examples of typical fillers include calcium carbonate, barium sulfate, wollastonite, mica, china clay, diatomaceous earth, benzoic acid, low molecular weight nylon, etc. Examples of typical pigments include inorganic pigments, such as titanium dioxide, etc., and organic pigments, such as carbon black, etc. In this invention, it has been found that the fillers and pigments also serve as nucleating agents, providing nucleating sites for recrystallization of the crystalline resins. This, in turn, facilitates the formation of the desired low gloss finish.

The other common additives are typically present in a total amount of up to about 15 phr. Examples of typical flow control agents include acrylic resins, silicone resins, etc. Examples of typical dry flow additives include fumed silica, alumina oxide, etc. Examples of typical anticratering agents include benzoin, benzoin derivatives, low molecular weight phenoxy and phthalate plasticizers, etc. Examples of typical surfactants include acetylenic diol, etc. Examples of typical texturing agents include organophilic clays, crosslinlked rubber particles, multiple crosslinkers, etc. Examples of typical light stabilizers include hindered amines, hindered phenols, etc.

The UV curable coating powders employed in this invention are produced in the usual manner. The components are dry blended together, and then melt blended in an extruder with heating above the melting point of the resin. The extruded composition is rapidly cooled and broken into chips, and then ground with cooling, and, as necessary, the particulates are sorted according to size. Average particle size is typically between about 20–60 microns. Gaseous or supercritical carbon dioxide may be charged to the extruder to lower extrusion temperatures. This is particularly desirable with powders containing crystalline resins. These resins tend to experience drastic reductions in viscosity above their melting point, which, in turn, undesirably reduces the amount of shearing and mixing action occurring in the extruder.

Once the UV curable powders containing the crystalline resins are produced, they are ready for application onto a substrate to be coated.

A unique aspect of this invention is that the coater is given a choice to make either high gloss or low gloss coatings from the aforesaid powders depending on the processing steps employed during the coating operation. Although the aforesaid powders are formulated to generate low gloss coatings, they also have the ability to form high gloss coatings, depending on the processing. Thus, the same UV curable powders can now be used to generate either a high or low gloss finish depending on aesthetic preference. Prior to this invention, only high gloss coatings could be made with UV curable powders. Never before has the coater been able to choose between the two with UV curable powders.

Accordingly, at start-up of the UV coating operation, the coater must determine whether a high gloss or low gloss coating is desired and make the appropriate selection. Once the selection is made, the processing steps employed after heat fusion control which type of coating will be made, as will be explained below. It should be understood gloss determination and selection may come at any point along the coating operation before curing.

The UV curable powders are then applied in the usual fashion, e.g., electrostatically, to a substrate to be coated. Usually electrostatic spray booths are employed which house banks of corona discharge or triboelectric spray guns and recirculators for recycling over sprayed powders back into the powder feed.

Next, the powders are exposed to sufficient heat to fuse (i.e., melt) and flow out the powders into a continuous, smooth, molten film. The substrate may be heated at the time of application (pre-heated) and/or subsequently (post-heated) to effect heat fusion and film formation. Heating is performed in infrared, convection ovens, or a combination of both. When coating heat sensitive substrates, such as wood articles, pre-heat and post-heat steps are normally employed to enable faster melt and flow out. With plastic articles, only a post-heat step is usually performed to limit heat exposure and avoid plastic deformation.

Furthermore, when forming low gloss coatings with dual cure powders, care must be taken during heat fusion to minimize thermal curing from taking place. Otherwise, the crosslinker resin will co-polymerize with the base resin and thus prevent the crystalline resin component from recrystallizing, which action is needed to produce low gloss coatings, as will be explained below. Accordingly, with dual cure powders, during heat fusion, the melt and flow out temperature should be kept below the activation temperature of the thermal initiator.

During heat fusion, the UV curable powders employed in this invention have the ability to melt and flow out into smooth films very rapidly (e.g., 5–190 seconds) at very low melting temperatures (e.g., 160–300° F.). The heat load on the substrate during coating is thereby significantly reduced, making these powders especially suited for coating heat sensitive substrates. Usually, the flow viscosity is also very low (e.g., 100–4,000 cone and plate) which helps to produce extraordinarily smooth coatings. Further, heat fusion is allowed to proceed for as long as it takes to outgas all substrate volatiles, which prevents surface defects, such as blisters, craters, and pinholes, from forming during curing. The low cure temperature also helps to reduce substrate outgassing and resultant degradation.

When a high gloss coating is selected, conventional UV processing is performed wherein curing with UV light immediately follows the heat fusion step, so that the coating is cured in its molten state.

When low gloss coating is selected, low gloss is achieved by allowing the heat fused UV curable coating containing the crystalline resins time to cool to desired low gloss or matte finish before curing with UV light. Cooling allows the crystalline resins time reorient in the crystal lattice which forms the low gloss coating. Such processing is highly unusual.

Conventional wisdom would lead one skilled in the art to believe that once the solid resins are allowed to cool, they would be too immobile to be able to crosslink. Accordingly, one skilled in the art would not expect that full cure could be achieved with cooling before curing with radiation. Nevertheless, the present inventors have unexpectedly found that not only can the desired full cure be attained, but also a low gloss coating can simultaneously be produced. The recrystallization also levels the coating, thereby eliminating the orange peel effect. The net result is that a surprisingly hard, chemical resistant, smooth, low gloss coating is produced.

Therefore, in accordance with this invention, when it is desired to produce low gloss coatings, immediately after heat fusing, the molten coating is removed from the heat and allowed to cool under ambient conditions. Cooling is continued for an effective time to allow the resins to flow and recrystallize to obtain the desired matte finish. Otherwise stated, the coating is allowed to cool down to at least the recrystallization temperature of crystalline resin component mixed in the coating or below. The cooling time will therefore depend on the choice of crystalline resins employed. It usually takes somewhere from about 1 to 60 minutes at 25° C., and more commonly from about 3 to 20 minutes, to recrystallize the crystalline materials in the coating. Recrystallization can be seen visually by formation of a matte finish.

Thereafter, the cooled coating having the desired matte finish is exposed under a standard UV light source, such as standard medium pressure mercury-, iron doped mercury-, and/or gallium doped mercury-vapor lamps, e.g., 600-watt Fusion H-, D- and/or V-lamps, respectively, to rapidly cure the coating films into smooth hardened finishes. Electron beam radiation may be used instead of UV radiation, if desired. Hardening of the coating takes between about 1 millisecond and 10 seconds, and typically less than about 3 seconds. The coating thickness that can be obtained with this method is typically between about 0.5 and 25 mils, and more commonly between about 1 and 10 mils. Even pigmented coatings can be fully cured by this method.

The glossiness of the cured coating (measured on a Gardner Gloss scale) can be reduced to about 50 or below, and preferably about 30 or below, using the method of this invention.

Referring now to FIG. 1, a diagram is provided showing how to effect either a high or low gloss coating using the same UV curable powders in accordance with the method just described.

The UV curable powder coatings employed in this invention are particularly suited for heat sensitive substrates. They are also suited for traditional heat resistant substrates. Examples of typical heat sensitive substrates include wood, such as hardwood, hard board, laminated bamboo, wood composites, such as particle board, electrically conductive particle board, high, medium or low density fiber board, masonite board, laminated bamboo, and other substrates that contain a significant amount of wood. These substrates may be filled or primed with UV liquids, powder primers, or solvent- or waterborne coatings to improve smoothness and reduce the required film builds. Other heat sensitive substrates include plastics, such as ABS, PPO, SMC, polyolefins, polycarbonates, acrylics, nylons and other copolymers which usually will warp or outgas when coated and heated with traditional heat curable powders, along with paper, cardboard, and composites and components having a heat sensitive aspect, etc. Examples of typical heat resistant substrates, include metal, steel, glass, ceramic, carbon and graphite.

In summary, this invention provides a generic method for producing either high or low gloss coatings using the same UV curable powders. More specifically, it provides a method for producing low gloss coatings from UV curable powders. The method is not limited to the aforesaid described UV curable powder coatings, which are merely exemplary, but describes a method applicable to all types of UV curable powder coatings containing crystalline resins which tend to produce high gloss films when processed in a conventional manner. The most surprising aspect of this invention is that once the heat fused powders have been allowed to cool and recrystallize, one skilled in the art would not expect that full cure could be achieved.

This invention will now be described in greater detail by way of specific examples.

EXAMPLE 1

Production of a Clear Low and High Gloss Coating from Identical UV Curable Powders The following ingredients were blended together in the given manner to produce a UV curable powder coating capable of forming either a high or low gloss finish after curing depending on the UV processing employed.

| INGREDIENTS | PHR |
|---|---|
| DRY BLEND UNTIL HOMOGENEOUS | |
| Uralac XP 3125[1] ® (Non-Crystalline) | 80 |
| ZW 3307P[2] ® (Crystalline) | 20 |
| Lucerin ® TPO[3] | 2.0 |
| Luperox ® ACP 35[4] | 0.5 |
| Nyad ® 475[5] | 60 |
| Modaflow 2000[6] | 1.5 |
| Surfynol ® 104[7] | 1.0 |
| CHARGE TO EXTRUDER AND EXTRUDE AT MELT TEMPERATURE OF 180° F. AIR COOL AND BREAK INTO CHIPS THEN ADD | |
| Aluminum Oxide C[8] | 0.2% |
| CHARGE TO MILL AND GRIND TO POWDER SCREEN TO −140 MESH | |

Table Footnotes

[1]Uralac XP 3125 ® is a solid, amorphous, unsaturated polyester resin based on fumaric acid, terephthalic acid, and 1,6-hexanediol, sold by DSM Resins.

[2]ZW 3307 ® a solid, crystalline, divinyl ether terminated urethane crosslinker resin based on hexamethylene diisocyanate and 4-hydroxybutyl vinyl ether, sold by DSM Resins. (By itself, this resin has a melting point of about 223° F. and recrystallization point of about 176° F.)

[3]Lucerin TPO ® is a photoinitiator composed of diphenyl (2,4,6-trimethylbenzoyl) phosphine oxide, sold by BASF.

[4]Luperox ACP 35 ® is a thermal initiator composed of 35 wt. % benzoyl peroxide on an inert dicalcium phosphate filler, sold by Elf Atochem.

[5]Nyad 475 ® is a filler composed of wollastonite, sold by Nyco Minerals.

[6]Modaflow 2000 is a polyacrylate flow control agent composed of ethyl acrylate, sold by Monsanto.

[7]Surfynol 104 ® is a surfactant composed of acetylenic diol, sold by Air Products.

[8]Aluminum Oxide C is a dry flow additive composed of aluminum oxide, sold by Degussa.

The above formulation was coated on Hyzod GP9160® polycarbonate sheets by the following method. First, the plastic sheets were cleaned with isopropyl alcohol and coated with a standard waterborne electrostatic spray coating (MorPrep® 1P 9902, sold by Morton International). The coating was then dried on each sheet using compressed air and wiped with a clean cloth.

Next, a determination was made that one of the sheets should receive a matte clear finish, while the other should receive a high gloss clear finish.

Then, the above UV curable powder formulation was applied electrostatically onto the pretreated sheets with a Nordson 100 KV Corona Gun. Next, the applied powders were fused with medium wave quartz IR lamps (50% intensity) for about a 1 minute exposure into a continuous smooth molten coating film. The surface temperature attained at this point was about 220–240° F.

For the low gloss coating, the selected sheet was removed from the heat after fusion and the molten coating was allowed to cool to a surface temperature of about 120° F. (which took about 5–6 minutes under ambient conditions) to obtain a matte finish. Thereafter, the coating was radiation cured by conveying the sheet through a Fusion UV oven housing a 600-watt V-lamp (400–420 nm) at about 20 ft/min for about a 1 second exposure.

For the high gloss coating, the selected sheet was radiation cured immediately after heat fusion by conveying the sheet with coating still molten through the Fusion UV oven in the same manner as described above.

Performance results of the cured coatings are given in the Table below.

| PROPERTIES | WITH COOLING (Low Gloss) | CURED IMMEDIATELY (High Gloss) |
|---|---|---|
| Thickness | 1.7–2.2 mils | 2.0–3.0 mils |
| 60° Gloss | 25 | 75 |
| Smoothness | No Orange Peel | Slight Orange Peel |
| Crosshatch Adhesion | 4B | 3B |
| MEK Resistance (50 double rubs) | 4 | 5 |
| Pencil Hardness (mar/gouge) | HB/2H | HB/2H |

EXAMPLE 2 (COMPARATIVE)

For comparative purposes, the crystalline vinyl ether crosslinker resin (ZW 3307P) used in the UV curable powder formulation of Example 1 was replaced with a non-crystalline vinyl ether crosslinker resin (Navicure®) based on isophorone diisocyanate, neopentyl glycol and 4hydroxybutyl vinyl ether. Otherwise, the formulation was prepared and processed in the same manner as provided in Example 1.

Performance results of the cured coatings are given in the Table below.

| PROPERTIES | WITH COOLING (No Gloss Reduction) | CURED IMMEDIATELY (High Gloss) |
|---|---|---|
| Thickness | 2.0–3.0 mils | 2.0–3.0 mils |
| 60° Gloss | 89 | 82 |
| Smoothness | Heavy Orange Peel | Heavy Orange Peel |
| Crosshatch Adhesion | 2B | 5B |
| MEK Resistance (50 double rubs) | 2 | 4 |
| Pencil Hardness (mar/gouge) | HB/F | H/2H |

The above results demonstrate that gloss reduction cannot be achieved without the presence of crystalline resins in the UV curable powder formulations.

EXAMPLE 3

Production of a White Low and High Gloss Coating from Identical UV Curable Powders The following ingredients were blended together in the same manner as Example 1.

| INGREDIENTS | PHR |
|---|---|
| Uralac XP 3125 (Non-Crystalline) | 80 |
| ZW 3307P (Crystalline) | 20 |
| Lucerin TPO | 2.0 |
| Luperox ACP 35 | 1.0 |
| Resiflow P67[1] ® | 1.5 |
| TiPure R-902[2] ® | 20.0 |
| Aluminum Oxide C | 0.2% |

Table Footnotes
[1]Resiflow P67 ® is a polyacrylate flow control agent, sold by Estron Chemical.
[2]TiPure R-902 ® is a white titanium dioxide pigment, sold by DuPont.

The above formulation was coated on wooden Medite HDF® cabinet doors by the following method to obtain either a matte white or high gloss finish.

First, the cabinet doors were lightly sanded followed by compressed air blow off to prepare the coating surface. The doors were then pre-heated in a convection oven either at 300° F./15 min or 350° F./10 min to attain a surface temperature of about 220–250° F.

Otherwise the doors were processed in the same manner as provided in Example 1, with the following exceptions: surface temperature after heat fusion was about 220–250° F.; and, it took 20 minutes for the fused coating to cool to 120° F. during low gloss processing.

Performance results of the cured coatings are given in the Table below.

| PROPERTIES | WITH COOLING (Low Gloss) | CURED IMMEDIATELY (High Gloss) |
|---|---|---|
| Thickness | 10–13 mils | 10–13 mils |
| 60° 0 Gloss | 13 | 90 |
| Smoothness | No Orange Peel | Slight to Moderate Orange Peel |
| Crosshatch Adhesion | 2B | 3B |
| MEK Resistance (50 double rubs) | 4–5 | 5 |
| Pencil Hardness (mar/gouge) | F/5H | F/5H |

EXAMPLE 4

Production of a Clear Low and High Gloss Coating From Identical UV Curable Powders The following ingredients were blended together in the same manner as Example 1.

| INGREDIENTS | PHR |
|---|---|
| Pioester 313[1] (Crystalline) ® | 100 |
| Lucerin TPO ® | 2.0 |
| Resiflow P67 ® | 1.5 |
| Nyad 475 ® | 60 |
| Aluminum Oxide C | 0.2% |

Table Footnotes
[1]Pioester 313 ® is a solid, crystalline, unsaturated polyester resin based on terephthalic acid, fumaric acid, and ethylene glycol, sold by Pioneer Plastics. (By itself, this resin has a melting point of about 226° F. and a recrystallization point of about 140° F.)

The above formulation was coated on Hyzod GP9160 polycarbonate sheets by the same method as in Example 1.

Performance results of the cured coatings are given in the Table below.

| PROPERTIES | WITH COOLING (Low Gloss) | CURED IMMEDIATELY (High Gloss) |
|---|---|---|
| Thickness | 2.0–3.0 mils | 2.0–3.0 mils |
| 60° Gloss | 23 | 54 |
| Smoothness | Moderate Orange Peel | Heavy Orange Peel |
| Crosshatch Adhesion | 1B | 5B |
| MEK Resistance (50 double rubs) | 4 | 4 |
| Pencil Hardness (mar/gouge) | H/2H | H/2H |

From the foregoing it will be seen that this invention is one well adapted to attain all ends and objects hereinabove set forth together with the other advantages which are apparent and inherent. Since many possible variations may be made of the invention without departing from the scope thereof, the invention is not intended to be limited to the embodiments and examples disclosed, which are considered to be purely exemplary. Accordingly, reference should be made to the appended claims to assess the true spirit and scope of the invention, in which exclusive rights are claimed.

What is claimed is:

1. A method for producing a coating having a low gloss appearance from a UV curable powder coating comprising:

a) applying onto a substrate a UV curable powder coating composition containing a crystalline resin in an amount effective to generate a low gloss coating;

b) fusing said curable powder coating with heat;

c) allowing the heat fused coating to cool for a period of at least 1 minute to recrystallize an amount of said crystalline resin effective to obtain a matte finish; and d) curing said coating with radiation to a hardened low gloss coating.

2. The method of claim 1, wherein:

said cured coating has a 60° Gardner Gloss of about 50 or below.

3. The method of claim 1, wherein:

said cured coating has a 60° Gardner Gloss of about 30 or below.

4. The method of claim 1, wherein:

said substrate is a heat sensitive substrate.

5. The method of claim 1, wherein:

said UV curable powder composition contains at least about 15 wt. % crystalline resin relative to total resin in said powder composition.

6. The method of claim 1, wherein:

said heat fused coating is allowed to cool in step c) to at least the recrystallization temperature of said crystalline resin in said powder composition.

7. The method of claim 5, wherein:

said powder composition further consists essentially of iv) a thermal initiator.

8. The method of claim 7, wherein:

said powder composition further consists essentially of v) a metal catalyst.

9. A method for producing a coating having a low gloss appearance from a UV curable powder coating, comprising:

a) applying onto a substrate a UV curable powder coating composition consisting essentially of:

i) an unsaturated based resin;

ii) an unsaturated co-polymerizable crosslinker resin; and, iii) a photoinitiator, wherein at least about 15 wt. % of the resin component i) plus ii) of said powder composition is crystalline resin;

b) fusing said UV curable powder coating with heat;

c) allowing the heat fused coating to cool for a period of at least 1 minute to recrystallize said crystalline resin so as to obtain a matte finish; and, d) curing said coating with UV radiation to a hardened low gloss coating having a 60° Gardner Gloss of about 50 or below.

10. The method of claim 9, wherein:

said cured coating has a 60° Gardner Gloss of about 30 or below.

11. The method of claim 9, wherein:

said crystalline resin is provided by the i) base resin, the ii) crosslinker resin, or both.

12. The method of claim 9, wherein:

said i) base resin is an unsaturated polyester resin; and, said ii) crosslinker resin is a vinyl ether terminated urethane resin.

13. The method of claim 9, wherein:

said powder composition further consists essentially of iv) a metal catalyst.

14. In a method for forming a coating on a substrate including providing a UV curable powder coating, applying the powder coating to said substrate, fusing said powder coating with heat followed by radiation curing the fused powder on said substrate, the improvement comprising:

a) including at least one crystalline resin in said UV curable powder coating composition; and, b) after fusion is effected, allowing the fused coating to cool for a period of at least 1 minute to reduce the gloss of the coating before radiation curing is effected.

15. The method of claim 14, wherein:

said substrate is plastic or wood.

16. A method for producing a coating having either a high or low gloss appearance from a UV curable powder coating, comprising:

a) providing a UV curable powder coating composition containing an amount of crystalline resin effective to generate a high or low gloss coating;

b) determining whether a high or low gloss coating is desired;

c) applying onto a substrate said UV curable powder coating;

d) fusing said UV curable powder coating with heat to a molten state;

e) curing the coating with UV radiation to the selected gloss appearance, provided that when a high gloss coating is selected in step (b) the curing step (e) is effected immediately following heat fusion step (d) so that the fused coating is cured in its molten state and when a low gloss coating is selected in step (b) the molten coating is allowed to cool for a period of at least 1 minute to recrystallize an amount of said crystalline resin effective to obtain a matte finish before curing step (e) is effected.

17. The method of claim 16, wherein:

the low gloss coating has a 60° Gardner Gloss of about 50 or below; and, the high gloss coating has a 60° Gardner Gloss of above 50.

18. The method of claim 16, wherein:

said substrate is a heat sensitive substrate.

19. The method of claim 16, wherein:

said UV curable powder composition contains at least 15 wt. % crystalline resin relative to total resin in said powder composition.

20. The method of claim 16, wherein:

the molten coating is allowed to cool to at least the recrystallization temperature of said crystalline resin in said powder composition.

* * * * *